US006275997B1

(12) United States Patent
Richardson

(10) Patent No.: US 6,275,997 B1
(45) Date of Patent: Aug. 21, 2001

(54) GEL-CUSHION SOCKS

(76) Inventor: Vikki Richardson, 2714 E. Maria Ct., West Covina, CA (US) 91792

( * ) Notice: Subject to any disclaimer, the term of this patent is extended or adjusted under 35 U.S.C. 154(b) by 0 days.

(21) Appl. No.: 09/552,827

(22) Filed: Apr. 20, 2000

(51) Int. Cl.[7] ..... A43B 17/00
(52) U.S. Cl. ..... 2/239
(58) Field of Search ..... 2/239, 240, 241, 2/242, 413; 36/29

(56) References Cited

U.S. PATENT DOCUMENTS

| | | | | |
|---|---|---|---|---|
| D. 386,608 | | 11/1997 | Green . | |
| 3,795,994 | | 3/1974 | Ava . | |
| 4,062,131 | | 12/1977 | Hsiung . | |
| 4,194,249 | * | 3/1980 | Thorneburg | 2/239 |
| 4,255,949 | | 3/1981 | Thorneburg . | |
| 4,277,959 | | 7/1981 | Thorneburg . | |
| 4,520,635 | | 6/1985 | Shields et al. . | |
| 4,651,354 | * | 3/1987 | Petrey | 2/239 |
| 5,007,111 | * | 4/1991 | Adams | 2/22 |
| 5,133,088 | * | 7/1992 | Dunlap | 2/241 |
| 5,307,522 | | 5/1994 | Throneburg et al. . | |
| 5,675,992 | * | 10/1997 | Wrightenberry | 66/178 R |
| 5,708,985 | | 1/1998 | Ogden . | |
| 5,737,776 | * | 4/1998 | Jennings | 2/409 |
| 5,778,702 | * | 7/1998 | Wrightenberry | 66/178 R |
| 5,832,539 | * | 11/1998 | Williams | 2/239 |
| 6,021,527 | * | 2/2000 | Lessard | 2/239 |
| 6,041,443 | * | 3/2000 | Pas et al. | 2/239 |
| 6,083,185 | * | 7/2000 | Lamont | 602/65 |
| 6,108,820 | * | 8/2000 | Bernhardt | 2/239 |

FOREIGN PATENT DOCUMENTS

| | | | | |
|---|---|---|---|---|
| 2280839 | * | 2/1995 | (GB) | 2/239 |

* cited by examiner

*Primary Examiner*—John J. Calvert
*Assistant Examiner*—Alissa L. Hoey

(57) ABSTRACT

A gel-cushion socks for lessening the impact force on the foot of a user while running. The gel-cushion socks includes an ankle portion integrally coupled to foot portion. The foot portion has a heal, an instep, a sole and toe. The foot and ankle portions comprises a generally flexible material having an inner wall and an outer wall having lumen therebetween. The material is generally water impervious. A gel is positioned in the lumen such that the gel may dampen impact on the lumen.

12 Claims, 1 Drawing Sheet

GEL-CUSHION SOCKS

BACKGROUND OF THE INVENTION

1. Field of the Invention

The present invention relates to socks and more particularly pertains to a new gel-cushion socks for lessening the impact force on the foot of a user while running.

2. Description of the Prior Art

The use of socks is known in the prior art. More specifically, socks heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,795,994; 5,307,522; 4,062,131; 4,520,635; U.S. Des. Pat. No. 386,608; and U.S. Pat. Nos. 5,708,985; 4,255,949; 4,277,959.

While these devices fulfill their respective, particular objectives and requirements, the aforementioned patents do not disclose a new gel-cushion socks. The inventive device includes an ankle portion integrally coupled to foot portion. The foot portion has a heal, an instep, a sole and toe. The foot and ankle portions comprises a generally flexible material having an inner wall and an outer wall having lumen therebetween. The material is generally water impervious. A gel is positioned in the lumen such that the gel may dampen impact on the lumen.

In these respects, the gel-cushion socks according to the present invention substantially departs from the conventional concepts and designs of the prior art, and in so doing provides an apparatus primarily developed for the purpose of lessening the impact force on the foot of a user while running.

SUMMARY OF THE INVENTION

In view of the foregoing disadvantages inherent in the known types of socks now present in the prior art, the present invention provides a new gel-cushion socks construction wherein the same can be utilized for lessening the impact force on the foot of a user while running.

The general purpose of the present invention, which will be described subsequently in greater detail, is to provide a new gel-cushion socks apparatus and method which has many of the advantages of the socks mentioned heretofore and many novel features that result in a new gel-cushion socks which is not anticipated, rendered obvious, suggested, or even implied by any of the prior art socks, either alone or in any combination thereof.

To attain this, the present invention generally comprises an ankle portion integrally coupled to foot portion. The foot portion has a heal, an instep, a sole and toe. The foot and ankle portions comprises a generally flexible material having an inner wall and an outer wall having lumen therebetween. The material is generally water impervious. A gel is positioned in the lumen such that the gel may dampen impact on the lumen.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new gel-cushion socks apparatus and method which has many of the advantages of the socks mentioned heretofore and many novel features that result in a new gel-cushion socks which is not anticipated, rendered obvious, suggested, or even implied by any of the prior art socks, either alone or in any combination thereof.

It is another object of the present invention to provide a new gel-cushion socks which may be easily and efficiently manufactured and marketed.

It is a further object of the present invention to provide a new gel-cushion socks which is of a durable and reliable construction.

An even further object of the present invention is to provide a new gel-cushion socks which is susceptible of a low cost of manufacture with regard to both materials and labor, and which accordingly is then susceptible of low prices of sale to the consuming public, thereby making such gel-cushion socks economically available to the buying public.

Still yet another object of the present invention is to provide a new gel-cushion socks which provides in the apparatuses and methods of the prior art some of the advantages thereof, while simultaneously overcoming some of the disadvantages normally associated therewith.

Still another object of the present invention is to provide a new gel-cushion socks for lessening the impact force on the foot of a user while running.

Yet another object of the present invention is to provide a new gel-cushion socks which includes an ankle portion integrally coupled to foot portion. The foot portion has a heal, an instep, a sole and toe. The foot and ankle portions comprises a generally flexible material having an inner wall and an outer wall having lumen therebetween. The material is generally water impervious. A gel is positioned in the lumen such that the gel may dampen impact on the lumen.

Even still another object of the present invention is to provide a new gel-cushion socks that contains heat-resistant gel which will keep feet relatively cooler.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
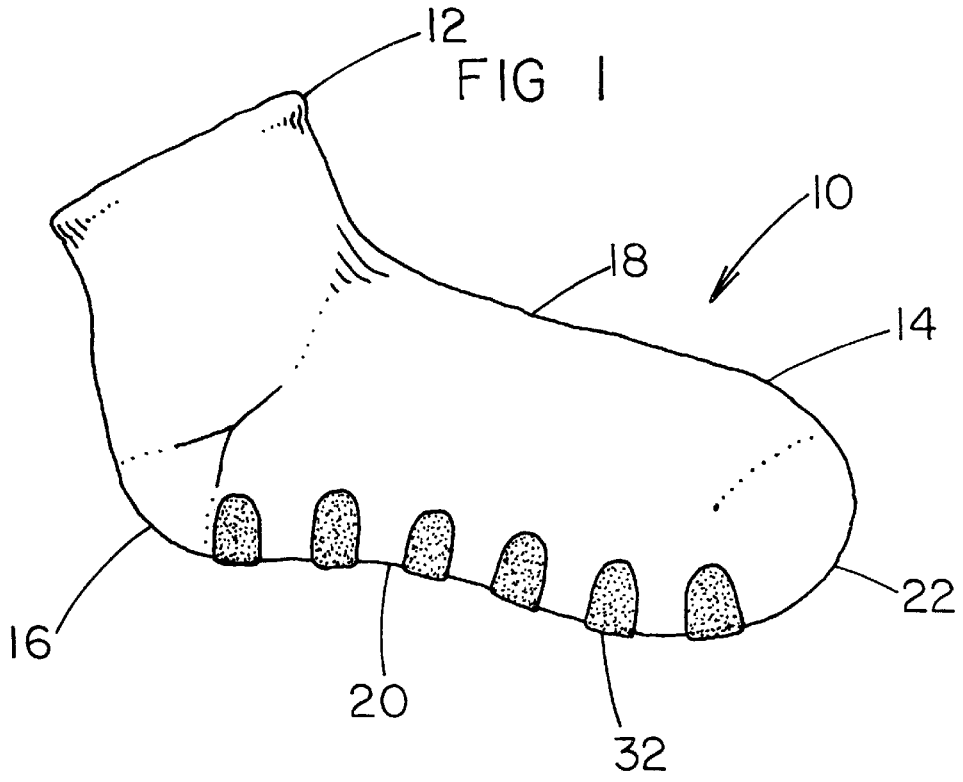
FIG. 1 is a schematic perspective view of a new gel-cushion socks according to the present invention.
Figure 2:
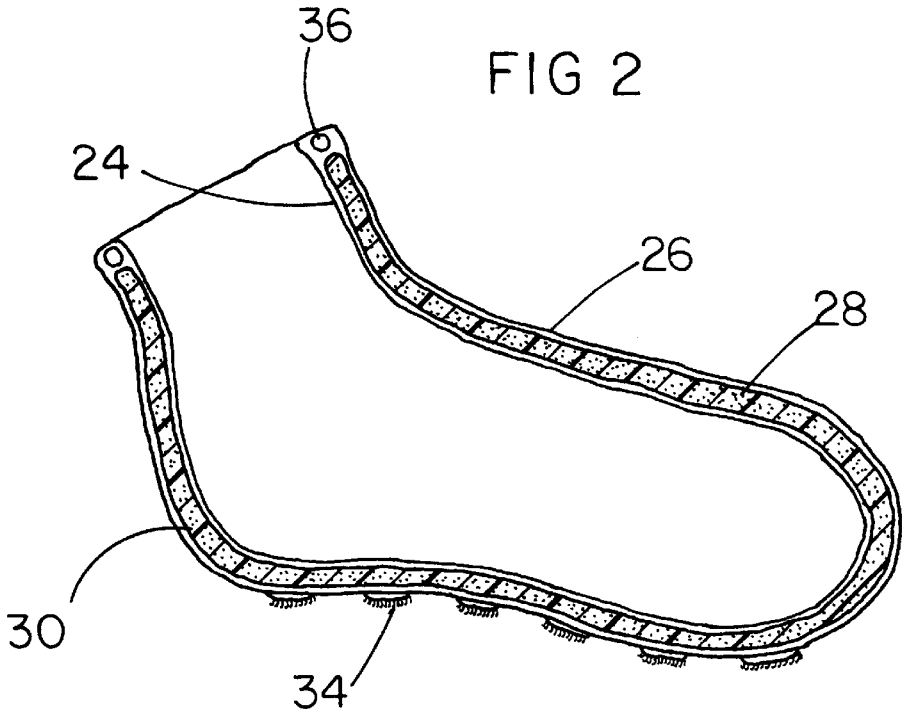
FIG. 2 is a schematic cross-sectional side view of the present invention.

With reference now to the drawings, and in particular to FIGS. 1 through 2 thereof, a new gel-cushion socks embodying the principles and concepts of the present invention and generally designated by the reference numeral 10 will be described.

As best illustrated in FIGS. 1 through 2, the gel-cushion socks 10 generally comprises an ankle portion 12 integrally coupled to foot portion 14. The foot portion 14 has a heal 16, an instep 18, a sole 20 and toe 22. The foot 14 and ankle 16 portions are comprised of a generally flexible material having an inner wall 24 and an outer wall 26 such that a lumen 28 exits therebetween. The material is generally water impervious. Preferably, the material is comprised of vinyl though any flexible water impervious material may be used.

A gel 30 is positioned in the lumen 28 such that the gel 30 is in the ankle portion 12 and the foot portion 14 and such that the gel 30 is sealed in the lumen 28. The gel 30 comprises a conventional heat resistant material.

A plurality of slip-resistant members 32 resists the falling of person wearing the socks. Each of the slip-resistant members is elongate, and has a first side is coupled to the sole 20 of the foot portion 14. Each of the slip-resistant members 32 is generally orientated transversely to the sole 20. Each of the slip-resistant members 32 has a second side 34 facing away from the foot portion 14. The second sides 34 each have a roughened surface. The second sides 34 may also be a hook means from a hook and loop fastening means which will grip the insides of shoes and walking surfaces.

An elastic band 36 is in the lumen 28 and is fixedly coupled to the ankle portion 12. The elastic band 36 is positioned generally adjacent to a free end of the ankle portion 12 and extends around the ankle portion 12.

In use the gel dampens impact when a load is applied thereto, thus offering comfort for the wearer. The gel is also heat resistant to keep the feet of the user relatively cooler.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cushion foot sock comprising:

an ankle portion integrally coupled to foot portion, said foot portion having a heel, an instep, a sole and toe, said foot and ankle portions comprising a generally flexible material having an inner wall and an outer wall and having lumen therebetween, said material being generally water impervious;

a gel, said gel being positioned in said lumen of said ankle portion and said foot portion, wherein said gel is sealed in said lumen such that said gel separates said inner wall from said outer wall at substantially all locations of said ankle portion and said foot portion.

2. The cushion foot sock as in claim 1, wherein the inner wall and the outer wall of said material comprise vinyl.

3. The cushion foot sock as in claim 1, wherein said gel comprises a heat resistant material.

4. The cushion foot sock as in claim 1, further comprising:

a plurality of slip-resistant members, each of said slip-resistant members being coupled to an outside surface of said sole of said foot portion.

5. The cushion foot sock as in claim 4, wherein said foot portion has a longitudinal axis extending between said heel and said toe, and each of said slip-resistant members being elongate, each of said slip-resistant members having a first side being coupled to said sole of said foot portion, each of said slip-resistant members being generally orientated transversely to said sole, each of said slip-resistant members having a second side facing away from said foot portion, said second sides each having a roughened surface.

6. The cushion foot sock as in claim 1, further comprising:

an elastic band, said elastic band being in said lumen and being fixedly coupled to said ankle portion, said elastic band being positioned generally adjacent to a free end of said ankle portion and extending around said ankle portion.

7. A cushion foot sock comprising:

an ankle portion integrally coupled to foot portion, said foot portion having a heel, an instep, a sole and toe, said foot portion having a longitudinal axis extending between said heel and said toe, said foot and ankle portions comprising a generally flexible material having an inner wall and an outer wall and having lumen therebetween, said material being generally water impervious, said material comprising vinyl;

a gel, said gel being positioned in said lumen such that said gel is in said ankle portion and said foot portion, wherein said gel is sealed in said lumen such that said gel separates said inner wall from said outer wall at substantially all locations of said ankle portion and said foot portion, said gel comprising a heat resistant material;

a plurality of slip-resistant members, each of said slip-resistant members being elongate, each of said slip-resistant members having a first side being coupled to said sole of said foot portion, each of said slip-resistant members extending across said sole and being orientated generally transverse to said longitudinal axis of said foot portion, each of said slip-resistant members having a second side facing away from said foot portion, said second sides each having a roughened surface;

an elastic band positioned in said lumen and being fixedly coupled to said ankle portion, said elastic band being positioned generally adjacent to a free end of said ankle portion and extending around said ankle portion; and wherein said gel dampens impact when a load is applied thereto.

8. A cushion foot sock comprising:

an ankle portion integrally coupled to foot portion, said foot portion having a heel, a sole, and toe, said foot portion having a longitudinal axis extending between said heel and said toe, said foot and ankle portions comprising a generally flexible material having an inner wall and an outer wall and having lumen therebetween;

a gel being positioned in said lumen; and a plurality of slip-resistant members, each of said slip-resistant members being mounted on an outside surface of said outer wall of said material, each of said slip-resistant members being elongate, each of said slip-resistant members extending across said sole and being orientated generally transverse to said longitudinal axis of said foot portion.

9. The cushion foot sock as in claim 8, wherein the inner wall and the outer wall of said material comprise vinyl.

10. The cushion foot sock as in claim 8, wherein said gel comprises a heat resistant material.

11. The cushion foot sock as in claim 8, further comprising an elastic band positioned in said lumen and being fixedly coupled to said ankle portion, said elastic band being positioned generally adjacent to a free end of said ankle portion and extending around said ankle portion.

12. The cushion foot sock as in claim 8, wherein, each of said slip-resistant members has a side facing away from said foot portion that has a roughened surface.

* * * * *